US009531110B2

(12) United States Patent
Takahashi

(10) Patent No.: US 9,531,110 B2
(45) Date of Patent: Dec. 27, 2016

(54) COLLECTIVE CONNECTING STRUCTURE, GUIDE FRAME, CIRCUIT BODY HOLDING STATE GUIDE FRAME, AND COLLECTIVE CONNECTING METHOD

(71) Applicant: Yazaki Corporation, Tokyo (JP)

(72) Inventor: Takakazu Takahashi, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/940,596

(22) Filed: Nov. 13, 2015

(65) Prior Publication Data

US 2016/0141778 A1 May 19, 2016

(30) Foreign Application Priority Data

Nov. 14, 2014 (JP) ..... 2014-231536
Aug. 3, 2015 (JP) ..... 2015-153190

(51) Int. Cl.

| | |
|---|---|
| ***H01R 13/62*** | (2006.01) |
| ***H01R 13/518*** | (2006.01) |
| ***H01R 12/79*** | (2011.01) |
| *H01R 31/02* | (2006.01) |

(52) U.S. Cl.
CPC ..... *H01R 13/518* (2013.01); *H01R 12/79* (2013.01); *H01R 31/02* (2013.01)

(58) Field of Classification Search
CPC ... H01R 12/7011; H01R 12/70; H01R 13/518; H01R 12/79; H01R 31/02
USPC ..... 439/329
See application file for complete search history.

(56) References Cited

U.S. PATENT DOCUMENTS 3,796,986 A * 3/1974 Tamburro ..... H01R 12/79 439/329

FOREIGN PATENT DOCUMENTS

JP 2010-267488 A 11/2010

* cited by examiner

*Primary Examiner* — Javaid Nasri
(74) *Attorney, Agent, or Firm* — Sughrue Mion, PLLC

(57) ABSTRACT

A guide frame is used to collectively connect circuit body side connectors to device side connectors. The guide frame includes circuit body holding parts for holding a circuit body and connector pressing parts that abut on the circuit body side connectors. Each of the circuit body holding parts includes a circuit body placement surface and a projection projecting from the circuit body placement surface. Each of the connector pressing parts includes an elastic part having elasticity in a connector connection direction and a pressing side abutting part.

11 Claims, 13 Drawing Sheets

COLLECTIVE CONNECTING STRUCTURE, GUIDE FRAME, CIRCUIT BODY HOLDING STATE GUIDE FRAME, AND COLLECTIVE CONNECTING METHOD

CROSS-REFERENCE TO RELATED APPLICATIONS

The present application claims priority from Japanese Patent Application Nos. 2014-231536 filed on Nov. 14, 2014 and 2015-153190 filed on Aug. 3, 2015, the entire contents of which are incorporated herein by reference.

BACKGROUND OF THE INVENTION

Field of the Invention

The present invention relates to a collective connecting structure of connectors, in which a plurality of circuit body side connectors are collectively connected to a plurality of device side connectors using a guide frame. Also, the invention relates to the guide frame, a circuit body holding state guide frame, and a collective connecting method of the connectors.

Related Art

For example, a transmission of a vehicle is provided with a plurality of solenoid valves as electronic devices. The solenoid valve has an electronic component in the inside, and the outside of the solenoid valve is provided with a device side connector. Electrical connection to the device side connector is made by fitting a circuit body side connector into this device side connector. The circuit body side connectors are formed on the distal sections of a plurality of electric wires.

According to a structure disclosed in JP-A-2010-267488, electrical connection between plural device side connectors and plural circuit body side connectors is collectively made. In the case of the collective connection, a guide frame is used. The guide frame is formed in a frame shape with substantially a rectangle. The guide frame is formed with portions for fixing positions of the plural circuit body side connectors.

Patent Reference 1: JP-A-2010-267488

In the structure of JP-A-2010-267488, the positions of the plural circuit body side connectors are fixed by the guide frame, with the result that, for example, when a manufacturing positional deviation occurs in the plural device side connectors, there is a problem of becoming difficult to make the collective connection.

SUMMARY OF THE INVENTION

One or more embodiments provide a collective connecting structure of connectors for easily making collective connection by absorbing a positional deviation. In addition, one or more embodiments provide a guide frame, a circuit body holding state guide frame, and a collective connecting method of the connectors.

BRIEF DESCRIPTION OF THE DRAWINGS

FIG. 12A is a perspective view in the case of having the same circuit width, and FIG. 12B is an enlarged perspective view viewed from a direction of arrow A of FIG. 12A.

FIG. 13A is a perspective view in the case of having a narrow circuit width, and FIG. 13B is an enlarged perspective view viewed from a direction of arrow A of FIG. 13A.

DETAILED DESCRIPTION OF THE EMBODIMENTS

A collective connecting structure of connectors is a structure in which plural circuit body side connectors are collectively connected to plural device side connectors using a guide frame formed with a circuit body holding part and a connector pressing part. The circuit body holding part holds a distal section of a circuit body while absorbing a positional deviation in a connector arrangement direction, and the connector pressing part elastically abuts on the circuit body side connector along a connector connection direction.

Figure 1:
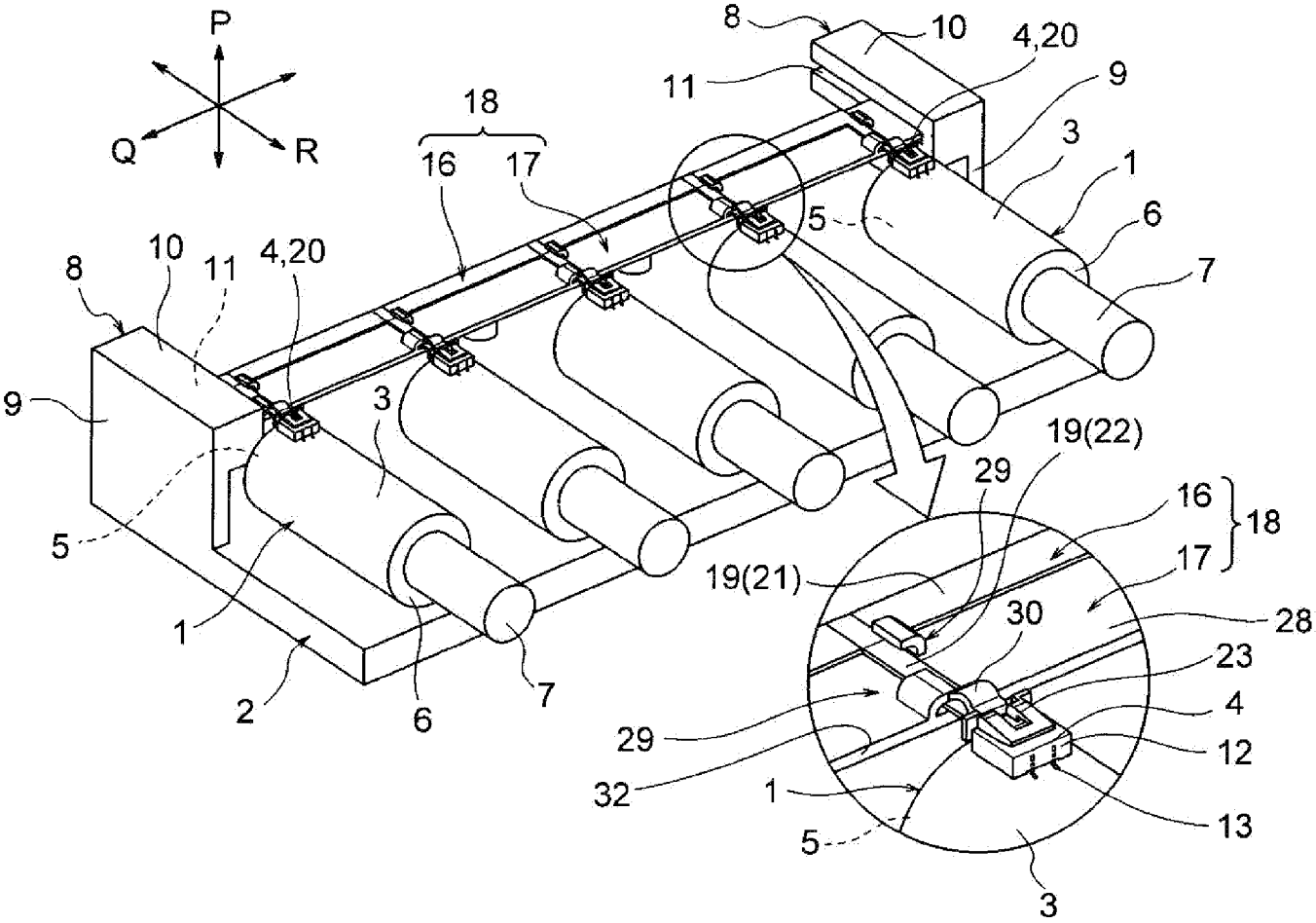
FIG. 1 is a perspective view and an enlarged view of a main part of a collective connecting structure of connectors.
Figure 2:
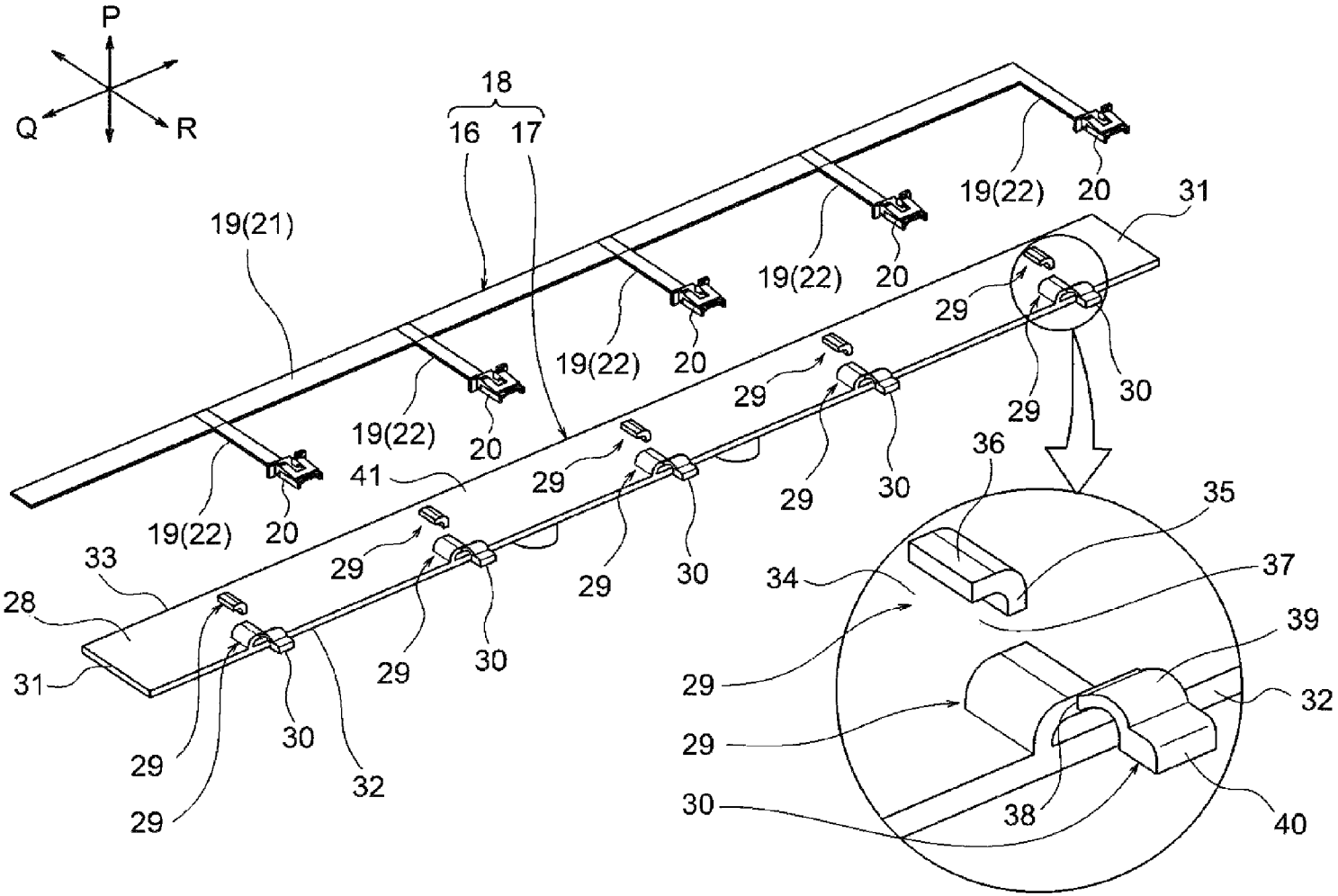
FIG. 2 is a perspective view of a guide frame and an FPC with circuit body side connectors constructing an FPC holding state guide frame of FIG. 1.
Figure 3:
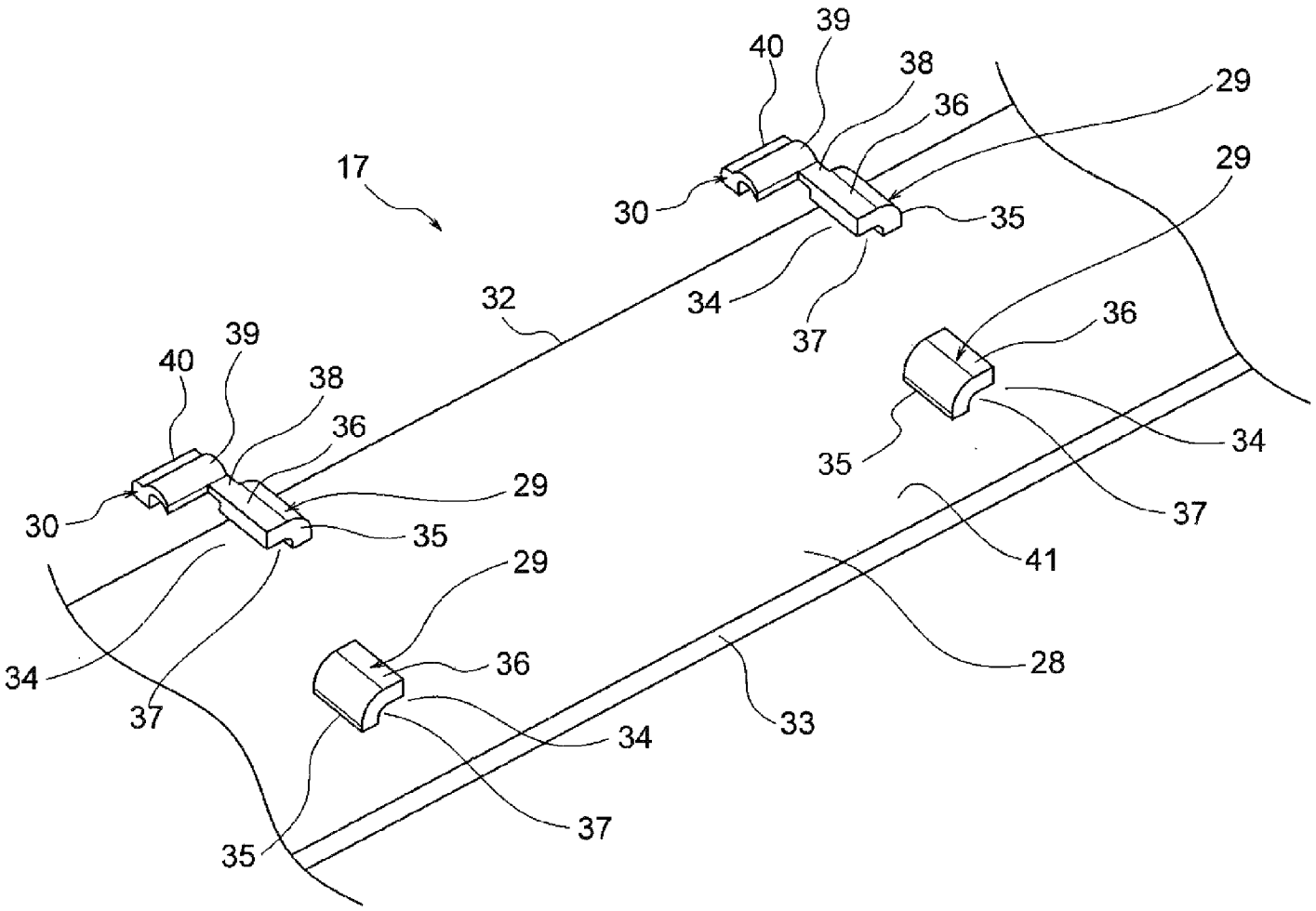
FIG. 3 is a main enlarged view of the guide frame of FIG. 2.
Figure 4:
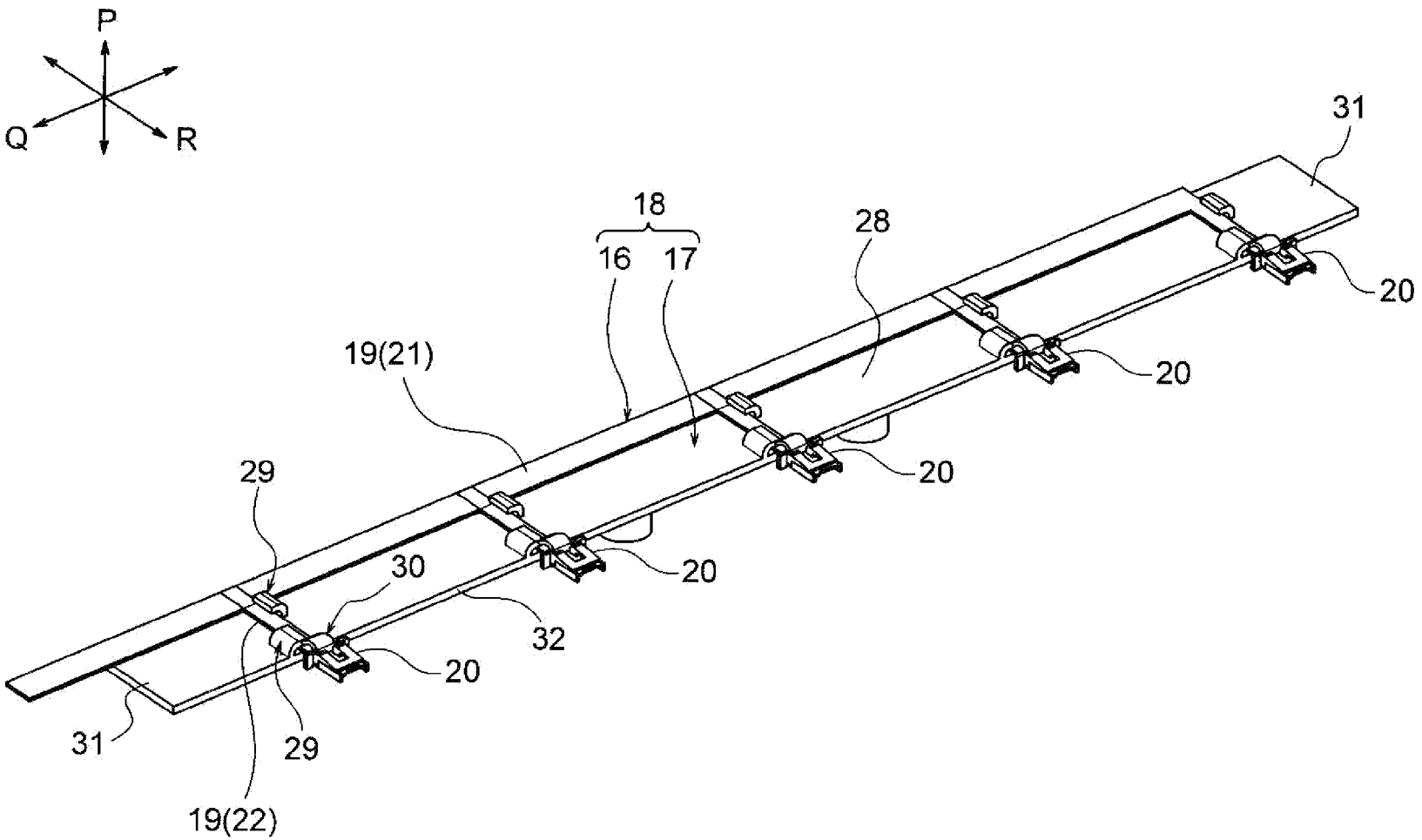
FIG. 4 is a perspective view of the FPC holding state guide frame showing a state in which the FPC with the circuit body side connectors of FIG. 2 is held in the guide frame.

An example will hereinafter be described with reference to the drawings. FIG. 1 is a perspective view and an enlarged view of a main part showing a collective connecting structure of connectors according to an exemplary embodiment. FIG. 2 is a perspective view of a guide frame and an FPC with circuit body side connectors constructing an FPC holding state guide frame of FIG. 1. FIG. 3 is a main enlarged view of the guide frame of FIG. 2. FIG. 4 is a perspective view of the FPC holding state guide frame showing a state in which the FPC with the circuit body side connectors of FIG. 2 is held in the guide frame.

In the following description, concrete shapes, materials, numerical values, directions, etc. are illustration for ease of understanding of the invention, and can properly be changed according to uses, purposes, specifications, etc.

In the following description, an electronic device etc. in a transmission of a vehicle is given, but shall be one example. In addition, arrow P in the drawings shows a vertical direction, and arrow Q shows a left-right direction (corresponding to a connector arrangement direction), and arrow R shows a front-back direction (corresponding to a connector connection direction).

In FIG. 1, reference numeral 1 shows a solenoid valve (device) as the electronic device. The solenoid valves 1 are arranged in the left-right direction at predetermined distances. The solenoid valve 1 is a device with substantially a columnar shape, and the five solenoid valves are formed in the present example. The five solenoid valves 1 are fixed to an upper surface of a solenoid fixing member 2. In addition, the solenoid fixing member 2 corresponds to a body panel of a vehicle in JP-A-2010-267488.

The solenoid valve 1 has an electronic component (not shown) in the inside, and an outer peripheral surface 3 of the solenoid valve 1 is provided with a device side connector 4. This device side connector 4 is arranged in the vicinity of a front end face 5 of the solenoid valve 1. An electric wire 7 is pulled out of a back end face 6 of the solenoid valve 1.

The solenoid fixing member 2 is provided with a pair of positioning parts 8. This pair of positioning parts 8 is arranged and formed in positions of both of the left and right sides of the five solenoid valves 1. The pair of positioning parts 8 is arranged and formed in the side of the front end face 5 of the solenoid valve 1.

The pair of positioning parts 8 has bases 9 upwardly projected from the upper surface of the solenoid fixing member 2, bulged parts 10 inwardly formed in distal section positions of the bases 9, and slit parts 11 formed by notching the bulged parts 10. The slit parts 11 will be described more concretely, and the slit parts 11 are formed as portions for guiding (as portions for sliding) both of the left and right ends 31 of a frame body 28 of a guide frame 17 described below. The slit parts 11 are formed with stopper portions (numeral is omitted) for regulating a slide amount of the guide frame 17. The slit parts 11 are arranged and formed according to positions of the device side connectors 4.

The device side connector 4 is configured to include a connector housing 12 made of resin having insulation, and a terminal 13 made of metal having conductivity. The inside of the connector housing 12 is formed with a fitting recess 14 (see FIG. 10). The outside of the connector housing 12 is formed with a locking projection 15 (see FIG. 10). One end of the terminal 13 is connected to an electronic component (not shown) of the inside of the solenoid valve 1. Also, the other end of the terminal 13 is exposed to the fitting recess 14 and connected to an FPC 19 described below.

An FPC with circuit body side connectors shown by reference numeral 16 is electrically connected to each of the device side connectors 4 of the five solenoid valves 1 as described above. Collective connection can be made using the guide frame 17 in this electrical connection.

First, a configuration and a structure of the FPC 16 with the circuit body side connectors will be described and next, a state in which the FPC 16 with the circuit body side connectors is held in the guide frame 17 (an FPC holding state guide frame 18) will be described. Electrical connection will be described. In addition, the description will be made with reference to FIGS. 5 to 11 as necessary in addition to FIGS. 1 to 4.

Figure 5:
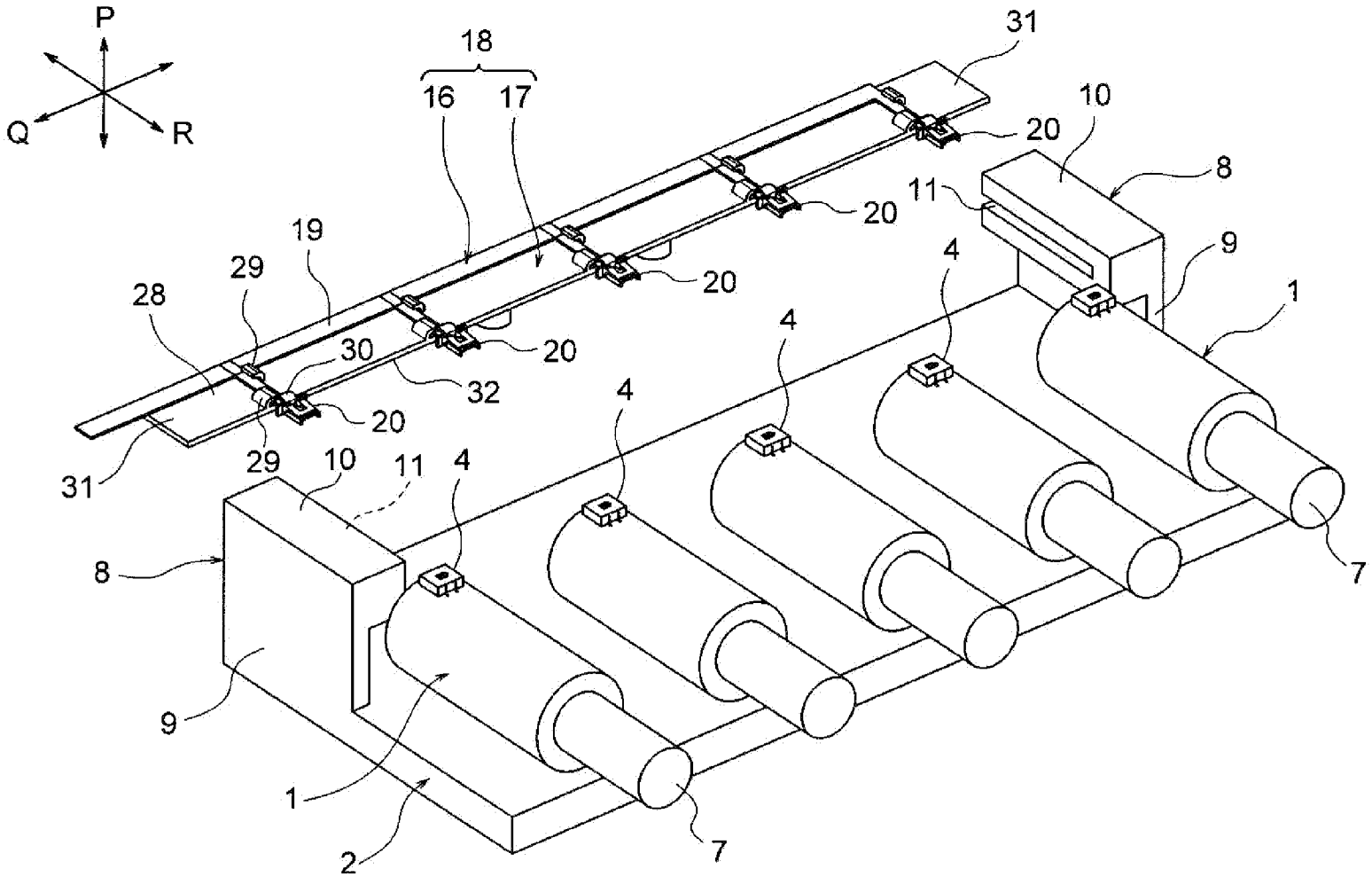
FIG. 5 is a perspective view showing a state just before connector connection between the circuit body side connector and a device side connector of a solenoid valve is made using the FPC holding state guide frame of FIG. 4.
Figure 6:
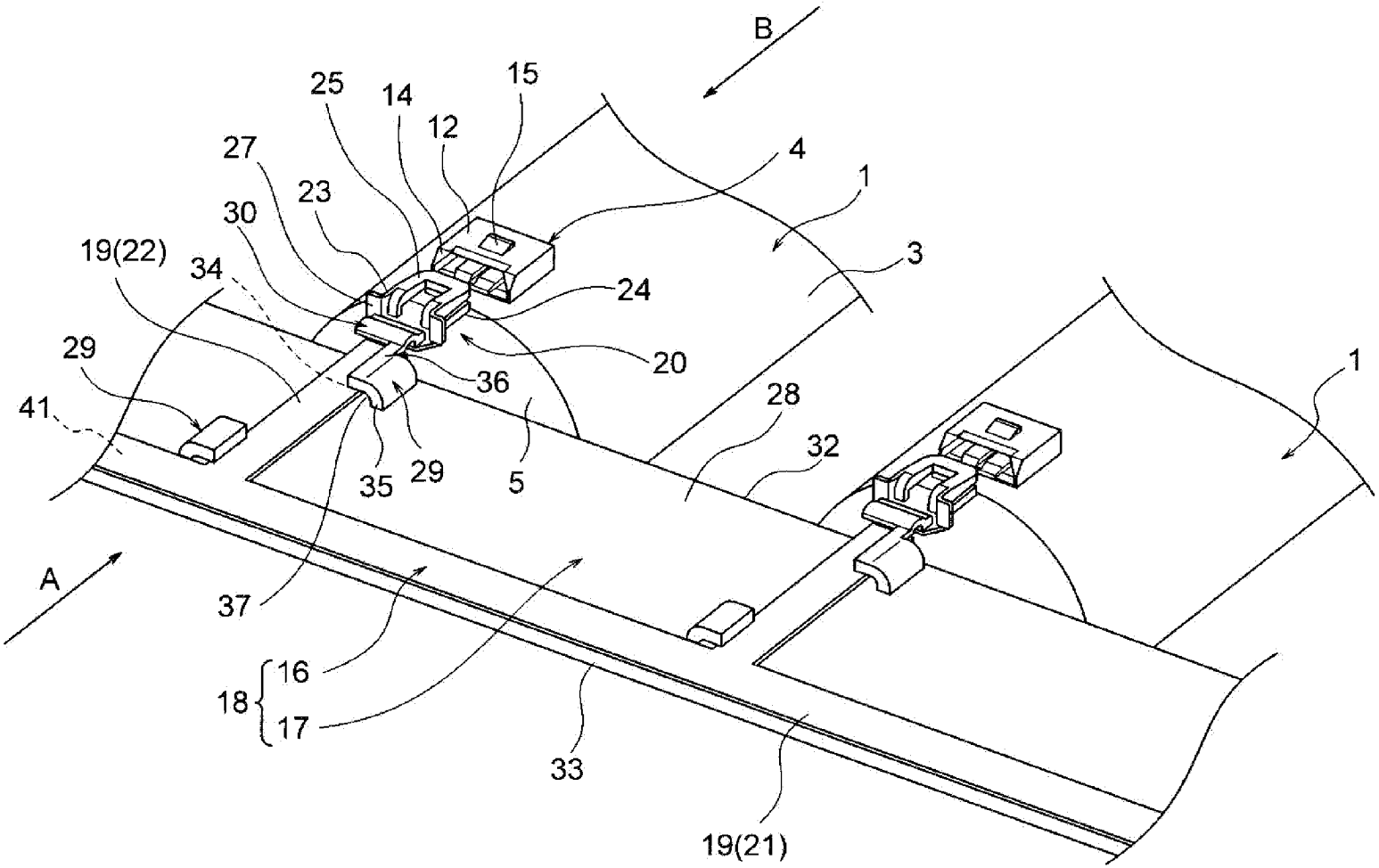
FIG. 6 is an enlarged perspective view at the time when the state of FIG. 5 is viewed from the side of the circuit body side connector.
Figure 7:
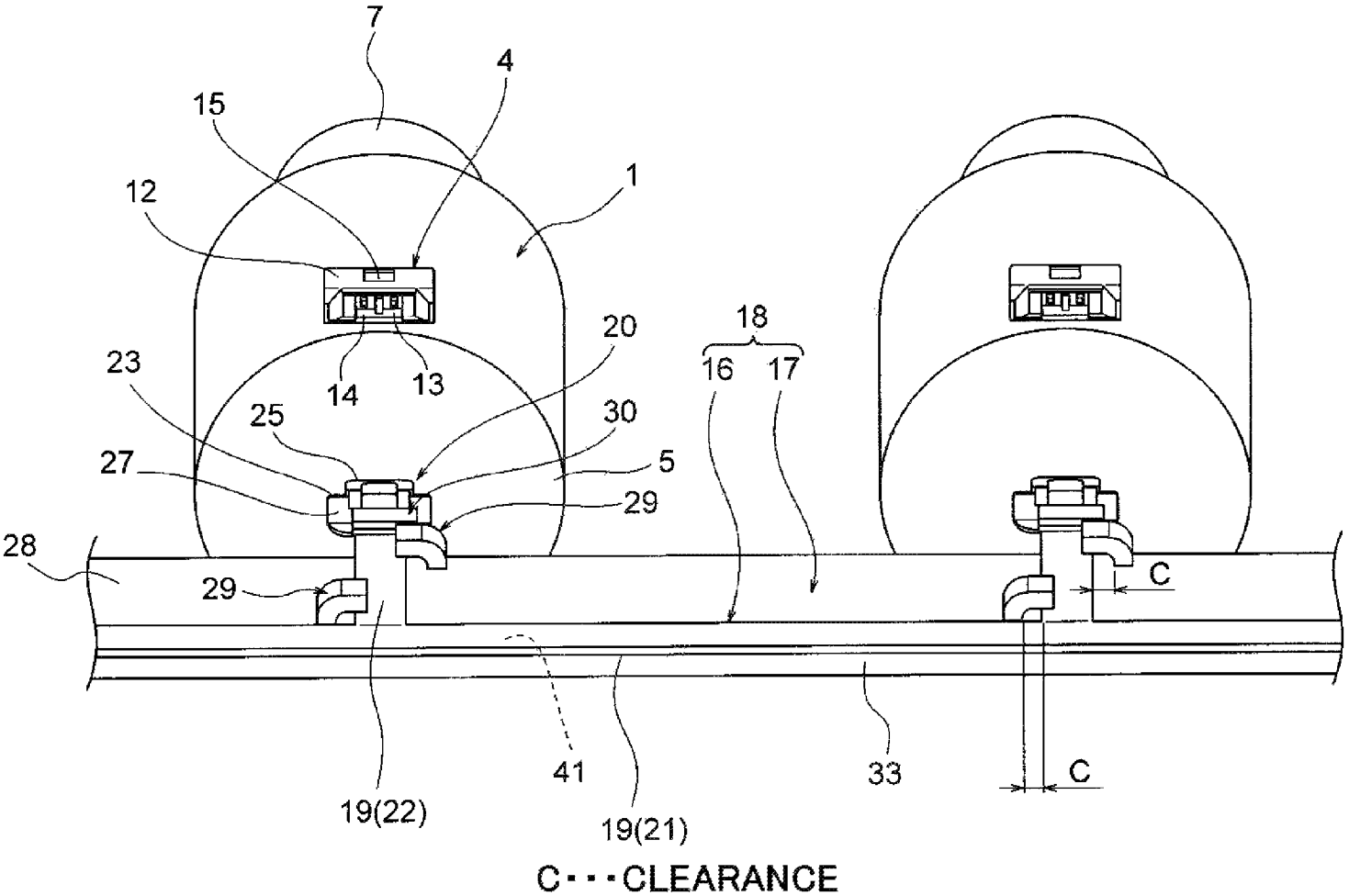
FIG. 7 is an enlarged perspective view viewed from a direction of arrow A of FIG. 6.
Figure 8:
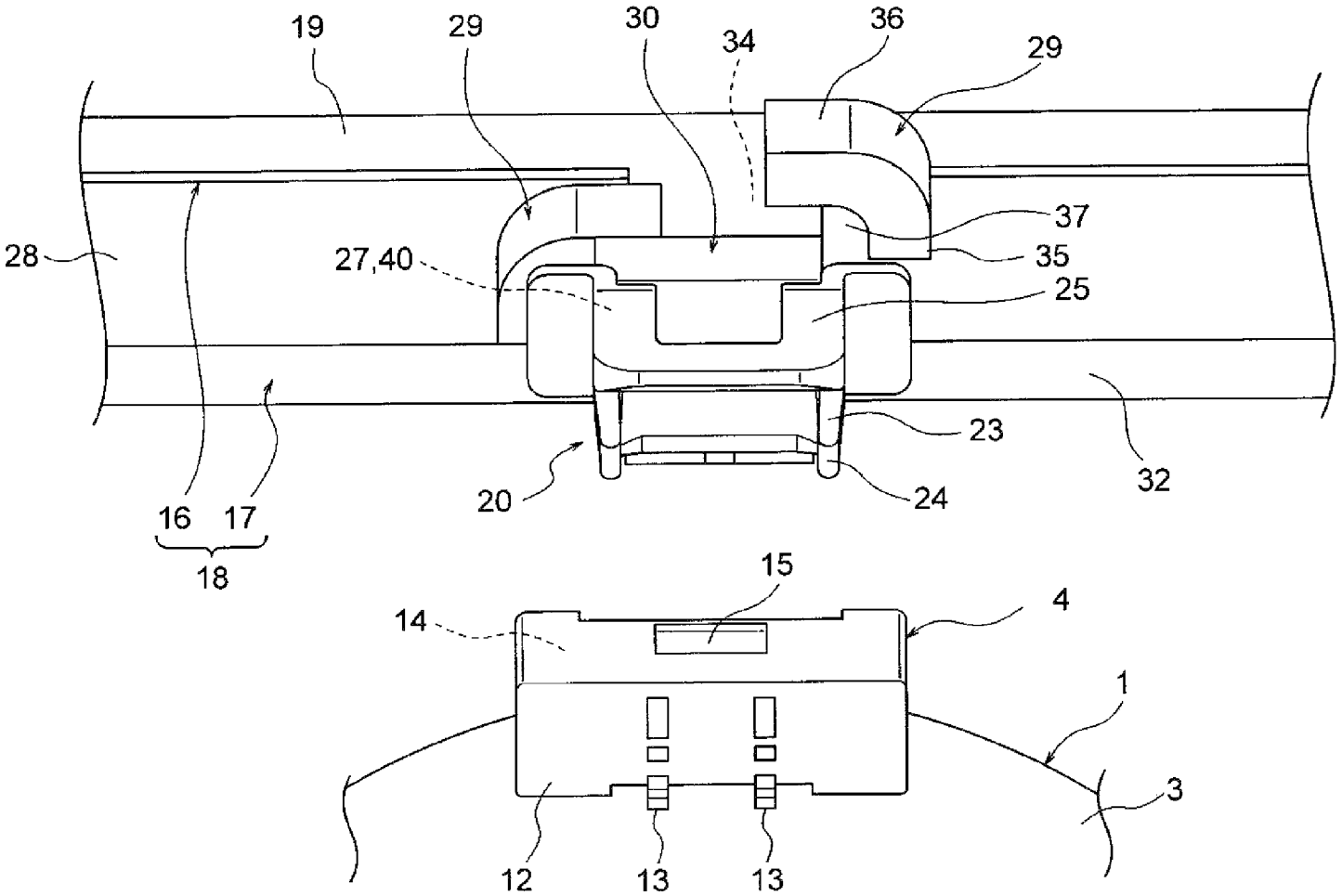
FIG. 8 is an enlarged perspective view viewed from a direction of arrow B of FIG. 6.
Figure 9:
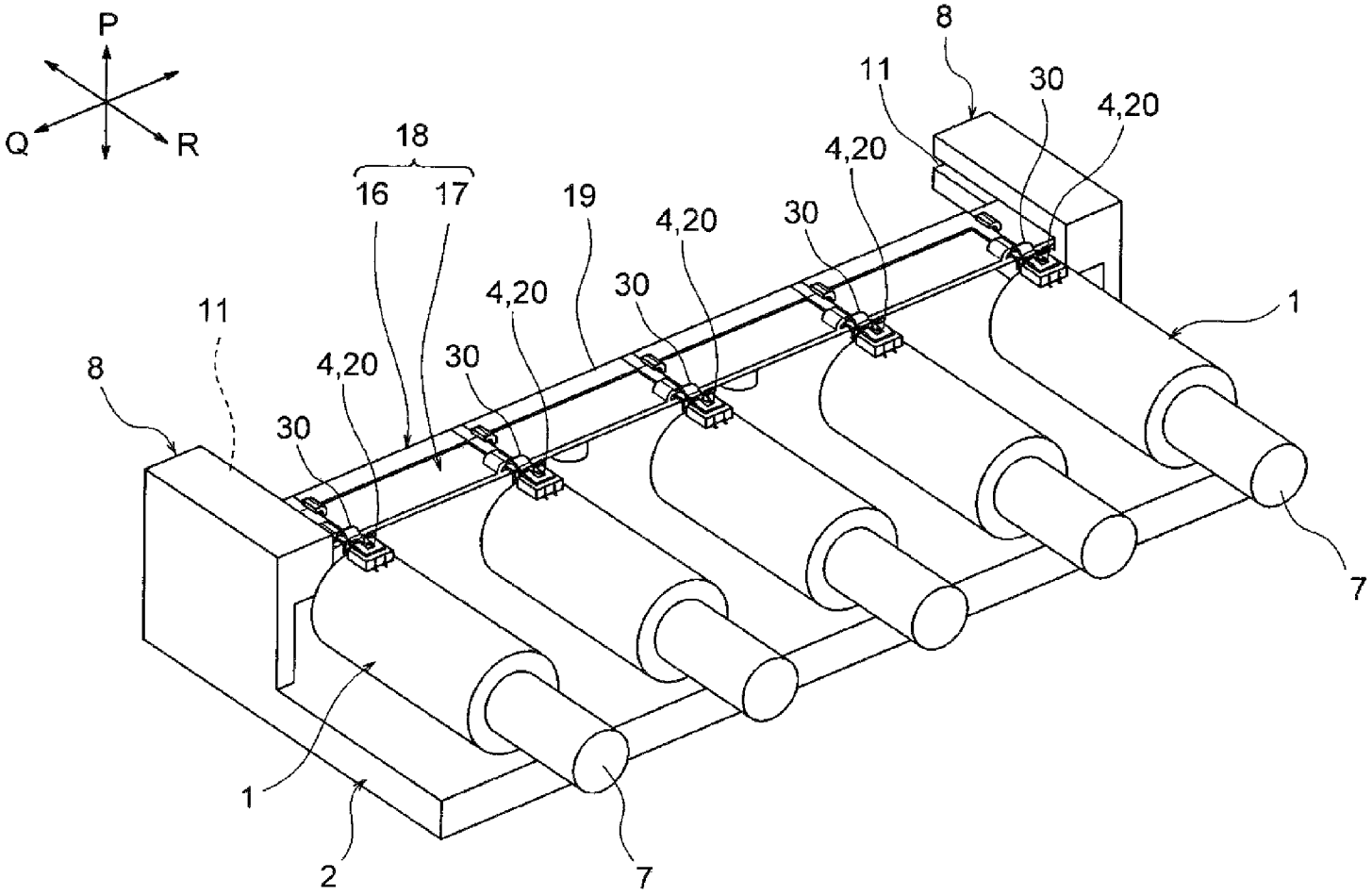
FIG. 9 is a perspective view showing a state in which connector connection between the circuit body side connector and the device side connector is made from the state of FIG. 5.
Figure 10:
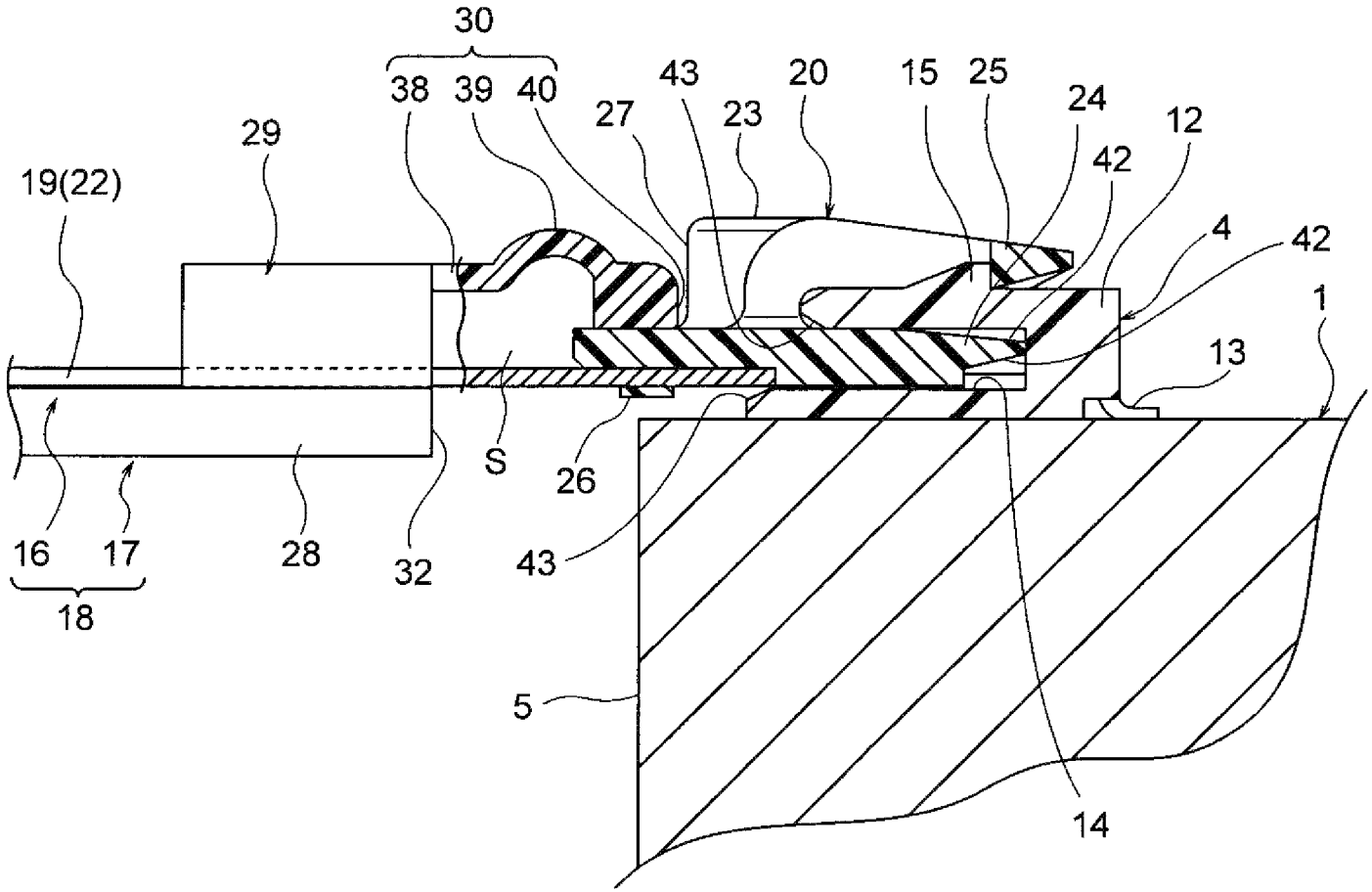
FIG. 10 is a sectional view of a connector connection portion of FIG. 9.
Figure 11:
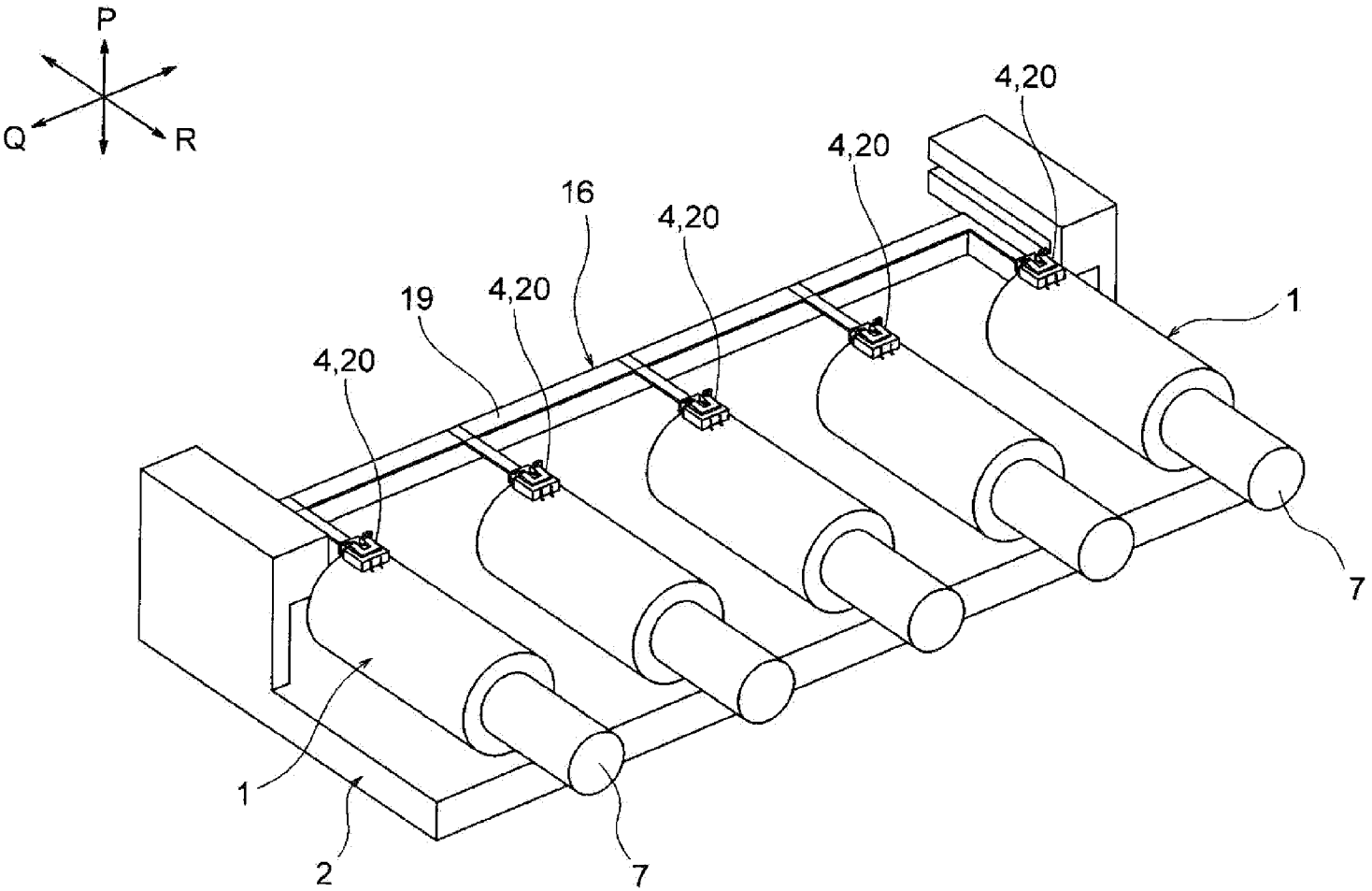
FIG. 11 is a perspective view showing a state after the guide frame is detached from the state of FIG. 9.

FIG. 5 is a perspective view showing a state just before connector connection is made using the FPC holding state guide frame 18 (circuit body holding state guide frame) of FIG. 4 (showing a state just before connector connection between a circuit body side connector 20 described below and the device side connector 4 of the solenoid valve 1 is made). FIG. 6 is an enlarged perspective view at the time when the state of FIG. 5 is viewed from the side of the circuit body side connector 20. FIG. 7 is an enlarged perspective view viewed from a direction of arrow A of FIG. 6. FIG. 8 is an enlarged perspective view viewed from a direction of arrow B of FIG. 6. FIG. 9 is a perspective view showing a state in which connector connection between the circuit body side connector 20 and the device side connector 4 is made from the state of FIG. 5. FIG. 10 is a sectional view of a connector connection portion of FIG. 9. FIG. 11 is a perspective view showing a state after the guide frame 17 is detached from the state of FIG. 9.

In FIG. 2, the FPC 16 with the circuit body side connectors has an FPC 19 (a circuit body, a flat connecting member), and the circuit body side connector 20 formed on the distal section of this FPC 19, and the FPC 19 and the circuit body side connector 20 are formed by a predetermined number (five in the present example), and are arranged in the left-right direction according to a position of the device side connector 4.

The FPC 19 is called a flexible printed circuit board, and is a flat-shaped electrical connecting member. As the flat-shaped electrical connecting member, for example, a flexible flat cable (FFC) is generally known in addition to this flexible printed circuit board. Since these connecting members have a flat shape, the connecting member has an advantage that the connecting member becomes thinner than a bundle of electric wires and space can be saved accordingly. In addition, reference numeral 21 in the drawings shows a portion (trunk line part) in which the FPC 19 is formed in a trunk shape. The reference numeral 22 shows a branch line part to the trunk line part 21. In the present example, the trunk line part 21 extends in the left-right direction, and the branch line part 22 extends in the front-back direction. The branch line part 22 is the portion corresponding to the distal section of the FPC 19.

In FIGS. 2 and 10, the circuit body side connector 20 includes a connector housing 23 made of resin having insulation, and is formed so that a circuit (not shown) of the FPC 19 can be connected to the terminal 13 of the device side connector 4. The connector housing 23 is formed with a fitting protrusion 24 inserted into the fitting recess 14 of the device side connector 4, a flexible locking piece 25 locked in the locking projection 15 of the device side connector 4, an FPC fixing part 26 for fixing the distal section of the FPC 19, and a connector side abutting part 27 on which a connector pressing part 30 described below abuts. The distal section of the FPC 19 is fixed in a state in close contact with a lower surface of the fitting protrusion 24. The connector side abutting part 27 is formed as a wall of the back of the circuit body side connector 20.

In FIGS. 2 and 3, the guide frame 17 is a resin molded product, and is formed so as to extend in the connector arrangement direction (the left-right direction in the present example). The guide frame 17 is formed as a member having rigidity so as not to flex easily in the case of connector connection or under the weight of the FPC 16 with the circuit body side connectors. The guide frame 17 is used for collectively connecting the FPC 16 with the circuit body side connectors to each of the device side connectors 4 of the five solenoid valves 1 as described above.

The guide frame 17 has the frame body 28. An upper surface of this frame body 28 is formed with plural (ten in the present example) FPC holding parts 29 (circuit body holding parts). The five FPC holding parts 29 arranged in the side near to the circuit body side connector 20 in the plural FPC holding parts 29 are respectively formed with the connector pressing parts 30 continuously. The guide frame 17 has the FPC holding parts 29 and the connector pressing parts 30 on the frame body 28 as described above. Hereinafter, description will be made in further detail.

The frame body 28 is formed as a strip plate-shaped portion. Both of the left and right ends 31 (left end 31, right end 31) of such a frame body 28 are formed as portions guided by being inserted into the slit parts 11 of the pair of positioning parts 8.

The FPC holding part 29 is a portion for holding the distal section (branch line part 22) of the FPC 19, and the distal section of the one FPC 19 is provided with at least the two FPC holding parts 29. In the present example, the two FPC holding parts 29 are formed. The two FPC holding parts 29 are arranged in staggered positions in both of the left and right sides of the distal section (branch line part 22) of the FPC 19. The FPC holding part 29 of the side near to the circuit body side connector 20 in the two FPC holding parts 29 is arranged according to a position of the edge of the frame body 28. Concretely, the FPC holding part 29 is arranged according to a position of a front edge 32. On the other hand, the other FPC holding part 29 is arranged at a predetermined distance from a back edge 33 of the frame body 28. Concretely, the FPC holding part 29 is arranged in the vicinity of a T-shaped portion of intersection between the branch line part 22 of the FPC 19 and the trunk line part 21 of the FPC 19. In addition, arranging the other FPC holding part 29 according to a position of this T-shaped portion has an effect capable of contributing to stabilization of arrangement of the FPC 19 or positioning of the FPC 19.

The FPC holding part 29 has a circuit body placement surface 34 and a projection 35, and is formed in an illustrated shape. The circuit body placement surface 34 is formed as a flat surface on which the distal section (branch line part 22) of the FPC 19 is placed. The projection 35 is formed as a portion upwardly projected from the circuit body placement surface 34. The projection 35 is formed in substantially a rib shape extending in the front-back direction. The projection 35 is formed as a portion for holding the distal section (branch line part 22) of the FPC 19. Such a projection 35 is formed with a placement surface opposed part 36 and an FPC insertion part 37 (a circuit body insertion part). The projection 35 is formed in substantially an inverted L shape by the placement surface opposed part 36 and the FPC insertion part 37.

The projection 35 is arranged and formed in a state in which a clearance C (see FIG. 7) is created for a left or right lateral part of the distal section (branch line part 22) of the FPC 19. That is, the projection 35 is arranged and formed so that a positional deviation in the left-right direction can be accommodated.

The placement surface opposed part 36 is formed as a holding portion opposed to the circuit body placement surface 34 at a predetermined distance (at a distance longer than a thickness of the branch line part 22). The FPC insertion part 37 is opened and formed as a portion capable of inserting the distal section (branch line part 22) of the FPC 19. The FPC insertion part 37 is formed as a slit-shaped portion.

In FIGS. 2, 3 and 10, the connector pressing part 30 is formed as a portion capable of pressing the circuit body side connector 20 to a normal connector fitting position. Such a connector pressing part 30 is formed so as to be continuous with the FPC holding part 29 (FPC holding part 29 of the side near to the circuit body side connector 20) arranged according to the position of the front edge 32 as described above. The connector pressing part 30 is formed so as to have flexible elasticity (elasticity) so that the circuit body side connector 20 can be pushed (In addition, it is not limited to the present example and, for example, an elastic member such as rubber or sponge is stuck and the connector pressing part 30 may be replaced with this elastic member). The connector pressing part 30 of the present example is formed with a continuous part 38, an elastic part 39, and a pressing side abutting part 40.

The elastic part 39 is formed as a U-shaped portion with a half cylindrical shape (the shape is one example, and may be a V shape etc.). The elastic part 39 has elasticity in the connector connection direction, and is formed in a shape uniformly flexible in the connector connection direction. The pressing side abutting part 40 is formed as a portion abutting on the connector side abutting part 27 of the back of the circuit body side connector 20. The pressing side abutting part 40 is arranged in the side nearer to the circuit body side connector 20 than the elastic part 39. Such a pressing side abutting part 40 is formed in a shape in which abutment on the connector side abutting part 27 is ensured in the connector arrangement direction. That is, the pressing side abutting part 40 is formed in the shape extending in the connector arrangement direction.

When the FPC 16 with the circuit body side connectors and the guide frame 17 are prepared and then the FPC 16 with the circuit body side connectors is held in the guide frame 17 in FIG. 2, the FPC holding state guide frame 18 is obtained as shown in FIG. 4.

In addition, for the holding described above, in the FPC 16 with the circuit body side connectors, the trunk line part 21 of the FPC 19 is placed on a trunk line placement part 41 of the guide frame 17.

Since the connector pressing part 30 of the guide frame 17 is projected from the position of the front edge 32 to the side of the device side connector 4 as is evident from FIGS. 3 and 10, when holding of the FPC 16 with the circuit body side connectors is completed, the circuit body side connector 20 formed on the distal section (branch line part 22) of the FPC 19 becomes a free end.

When both of the left and right ends 31 of the guide frame 17 in the FPC holding state guide frame 18 are inserted into the slit parts 11 of the pair of positioning parts 8 and are slid and moved in FIG. 5, with this slide movement, each of the circuit body side connectors 20 of the FPC 16 with the circuit body side connectors is straight moved toward each of the device side connectors 4 of the solenoid valves 1 (see FIGS. 6 to 8).

When connector fitting of the circuit body side connector 20 into the device side connector 4 is started (connector connection is started), the pressing side abutting part 40 of the connector pressing part 30 abuts on the connector side abutting part 27 of the circuit body side connector 20. Consequently, the circuit body side connector 20 is pushed to a fitting completion position (to a connection completion position) as shown in FIGS. 9 and 10 by action of the connector pressing part 30 (by action of the elastic part 39). Accordingly, the connector fitting (connector connection) is completed. The connector fitting (connector connection) is completed in five places in the present example. That is, collective connection is completed.

In addition, in the present example, a connector fitting start portion of the circuit body side connector 20 is formed with a taper 42 and also, a connector fitting start portion of the device side connector 4 is formed with a taper 43, with the result that the circuit body side connector 20 can naturally be guided to a normal fitting position of the device side connector 4.

When the guide frame 17 is detached after the collective connection is completed, it changes to a state as shown in FIG. 11, and a series of connection work is completed.

As described above with reference to FIGS. 1 to 11, according to the exemplary embodiment, in a structure of collectively connecting the plural connectors using the guide frame 17, the guide frame 17 is formed with the plural FPC holding parts 29 for holding the distal sections (branch line parts 22) of the FPC 19 while absorbing a positional deviation in the connector arrangement direction (left-right direction) and also, the FPC holding part 29 of the side near to the circuit body side connector 20 is formed with the connector pressing part 30 for elastically abutting on the circuit body side connector 20 along the connector connection direction (front-back direction), with the result that even when positional deviations in the connector arrangement direction and the connector connection direction occur, the positional deviations can be absorbed to make collective connection.

Consequently, it is possible to easily make the collective connection even when the manufacturing positional deviations occur.

Further, the connector fitting start portions are formed with the tapers 42, 43 for a connector guide, with the result that the circuit body side connector 20 can be guided to the normal fitting position of the device side connector 4.

Consequently, it is possible to easily make the collective connection between the connectors.

Also, the FPC holding part 29 continuous with the connector pressing part 30 is arranged according to the position of the front edge 32 of the guide frame 17, with the result that space S (see FIG. 10) is created between this edge 32 and the circuit body side connector 20, and this space S can be used as flexure allowable space of the distal section (branch line part 22) of the FPC 19.

Consequently, it is possible to absorb the positional deviation in the connector connection direction (front-back direction) by the arrangement described above.

The invention can naturally make various changes without departing from the gist of the invention.

For example, the invention is not limited to the exemplary embodiment described above, and a structure in which the connector pressing part 30 is projected from the front edge 32 or a surface opposite to the circuit body placement surface 34 and the distal section (branch line part 22) of the FPC 19 is upwardly arranged and the connector pressing part 30 is downwardly arranged in a position of this connector pressing part 30 may be adopted. That is, the structure of supporting the circuit body side connector 20 by the connector pressing part 30 may be adopted. This structure is effective in the case of fearing droop of the circuit body side connector 20.

Since the droop can be prevented while forming the circuit body side connector 20 with a free end, there is an effect capable of easily making the collective connection between the connectors.

Figure 12A:
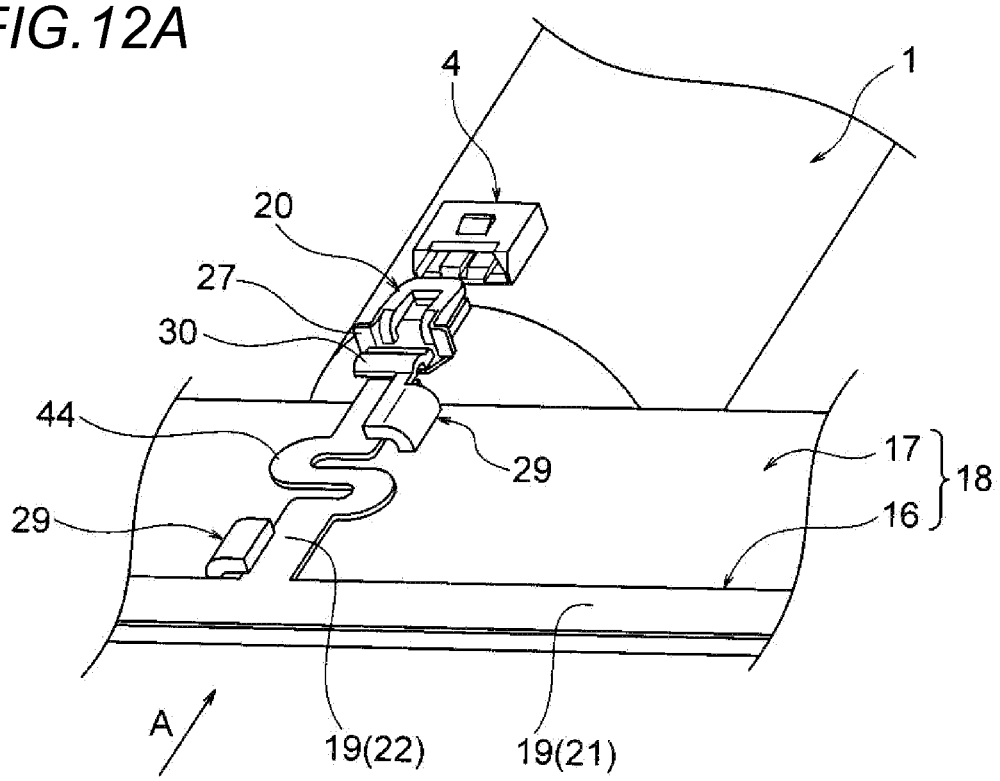
FIGS. 12A and 12B are views showing a modified example of the FPC.
Figure 12B:
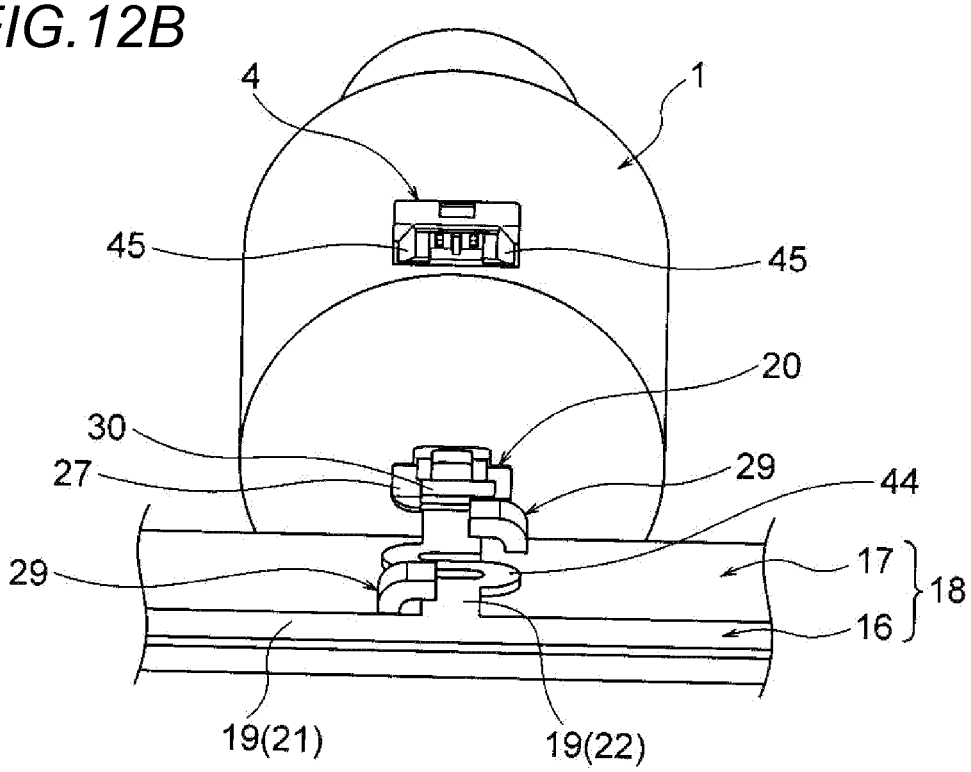
Figure 13A:
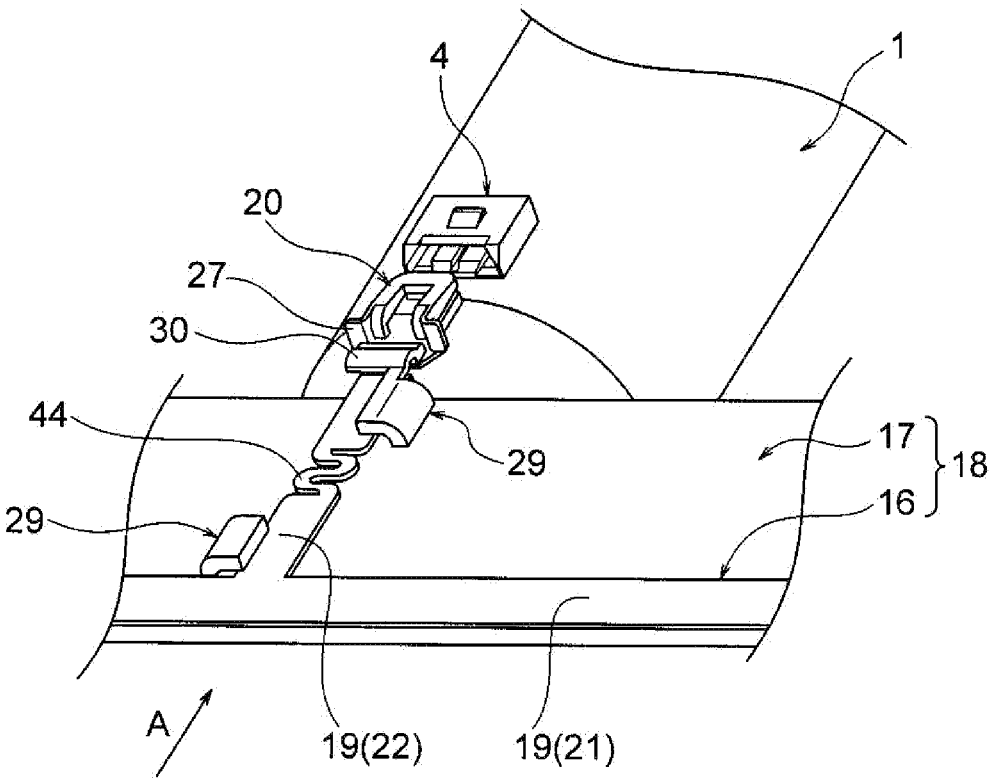
FIGS. 13A and 13B are views showing an another modified example of the FPC.
Figure 13B:
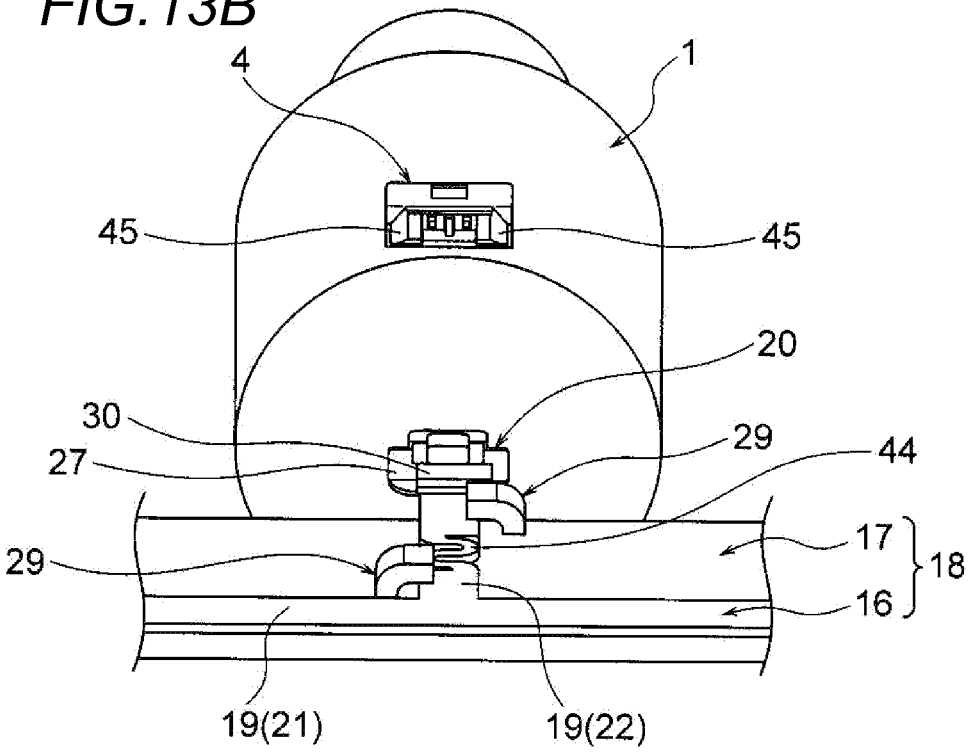

Other modified examples include examples as shown in FIGS. 12A, 12B, 13A and 13B. The modified examples of the branch line part 22 in the FPC 19 will hereinafter be described with reference to FIGS. 12A, 12B, 13A and 13B. FIGS. 12A and 12B are views showing a modified example in the case of having the same circuit width of the branch line part 22, and FIGS. 13A and 13B are views showing an another modified example in the case of having a narrow circuit width. In addition, since description herein only differs from that of the example of FIGS. 1 to 11 in a partial shape of the branch line part 22, the description is omitted by assigning the same reference numerals to portions other than characterizing portions.

In FIGS. 12A, 12B, 13A and 13B, a portion corresponding to a distal section of an FPC 19, that is, a branch line part 22 is formed with a positional deviation accommodation part 44. This positional deviation accommodation part 44 is formed as a portion displaceable (a portion deformable) in at least the left-right direction, preferably as a portion displaceable in the front-back direction too. In other words, the positional deviation accommodation part 44 is formed as the portion capable of accommodating a positional deviation when the positional deviation occurs. The positional deviation accommodation part 44 is formed in, for example, an extendable shape with substantially an S shape (the shape is one example, and the shape is not particularly limited as long as the positional deviation can be absorbed. The positional deviation accommodation part 44 is arranged and formed so as to be positioned between two FPC holding parts 29.

When an FPC holding state guide frame 18 is slid and moved in the configuration and the structure described above, with this slide movement, each of circuit body side connectors 20 of an FPC 16 with the circuit body side connectors is straight moved toward each of device side connectors 4 of solenoid valves 1. When connector fitting of the circuit body side connector 20 into the device side connector 4 is started (connector connection is started), a connector pressing part 30 abuts on the circuit body side connector 20. Consequently, the circuit body side connector 20 is pushed to a fitting completion position (to a connection completion position) by action of the connector pressing part 30. Accordingly, the connector fitting (connector connection) is completed.

In addition, in the modified examples of FIGS. 12A, 12B, 13A and 13B, a connector fitting start portion of the device side connector 4 is formed with tapers 45. Accordingly, the circuit body side connector 20 can be guided to a normal fitting position of the device side connector 4.

According to the examples of FIGS. 12A, 12B, 13A and 13B, the branch line part 22 is formed with the positional deviation accommodation part 44 as the portion capable of accommodating the positional deviations in the connector arrangement direction (left-right direction) and the connector connection direction (front-back direction), with the result that this positional deviation accommodation part 44 can be contributed in the case of making collective connection according to the connector fitting. Further, according to the modified examples, it is possible to easily do work in the case of holding the branch line part 22 in the two FPC holding parts 29 of a guide frame 17 by using characteristics of the displaceable positional deviation accommodation part 44. That is, workability can be improved.

In accordance with the embodiments, a collective connecting structure of connectors is configured to collectively connect a plurality of circuit body side connectors to a plurality of device side connectors. The plurality of circuit body side connectors are respectively formed on a plurality of distal sections of a circuit body and arranged according to arrangement of the plurality of device side connectors. The structure includes a guide frame extending in a connector arrangement direction. The guide frame includes circuit body holding parts configured to hold the circuit body, and connector pressing parts configured to abut on connector side abutting parts of the circuit body side connectors. Each of the circuit body holding parts includes a circuit body placement surface on which the circuit body is placed, and a projection projecting from the circuit body placement surface and arranged with a clearance to the circuit body in the connector arrangement direction. Each of the connector pressing parts includes an elastic part having elasticity in a connector connection direction, and a pressing side abutting part arranged in a side nearer to the circuit body side connector than the elastic part. The pressing side abutting part is formed so that an abutment with the connector side abutting part is ensured in the connector arrangement direction.

According to the structure, the structure collectively connects the plural connectors using the guide frame, and the guide frame is formed with the circuit body holding part for holding the circuit body while absorbing a positional deviation in the connector arrangement direction, and the connector pressing part for elastically abutting on the circuit body side connector along the connector connection direction. Therefore, when positional deviations in the connector arrangement direction and the connector connection direction occur, the positional deviations can be absorbed. Consequently, a collective connection is possible even when the manufacturing positional deviations occur.

In accordance with the embodiments, the projection includes a placement surface opposed part opposed to the circuit body placement surface at a predetermined distance, and a circuit body insertion part opened so that the circuit body is inserted.

According to the structure, since the projection of the guide frame is formed with the placement surface opposed part opposed to the circuit body placement surface at the predetermined distance and the circuit body insertion part opened so that the circuit body can be inserted, the projection can be formed in substantially an inverted L shape. Consequently, a deviation of the circuit body from its position can be prevented by such a shape.

In accordance with the embodiments, at least two circuit body holding parts are provided with respect to each of the distal sections of the circuit body. The two circuit body holding parts are arranged in a staggered state.

According to the structure, it is possible to make a holding force higher than the case of single circuit body holding part since the circuit body is held by at least the two circuit body holding parts. In addition, it is possible to stably hold, for example, a somewhat long circuit body since the two circuit body holding parts are arranged in the staggered state rather than opposed positions in both of the left and right sides of the circuit body. Moreover, it is possible to stabilize arrangement of the circuit body or positioning of the circuit body by arranging the one circuit body holding part according to a position of a T-shaped portion when the circuit body has the T-shaped portion.

In accordance with the embodiment, a taper for guiding the connector is formed in a connector fitting start portion of the each of the circuit body side connectors.

According to the structure, since the connector fitting start portion is formed with the taper for the connector guide, the circuit body side connector can be guided to a normal fitting position of the device side connector. Consequently, it is possible to easily make the collective connection between the connectors. In addition, a portion having the same function as the taper for the connector guide may be formed in the device side connector.

In accordance with the embodiments, a circuit body holding part nearest to the circuit body side connector in the two circuit body holding parts is arranged according to a position of an edge of the guide frame. The connector pressing part is projected along the connector connection direction from the circuit body holding part nearest to the circuit body side connector.

According to the structure, since the circuit body holding part nearest to the circuit body side connector is arranged according to the position of the edge of the guide frame and the connector pressing part is projected from this circuit body holding part along the connector connection direction, space is created between the circuit body holding part and the circuit body side connector. Therefore, it is possible to use the space as flexure allowable space of the circuit body. Accordingly, the positional deviation in the connector connection direction can be absorbed.

In accordance with the embodiments, the connector pressing parts are projected from a surface opposite to the circuit body placement surface or an edge of the guide frame along the connector connection direction.

According to the structure, since the connector pressing part is projected from the surface opposite to the circuit body placement surface or the edge of the guide frame along the connector connection direction, the connector pressing part is positioned lower than the circuit body between the circuit body side connector and the edge of the guide frame. As a result, it is possible to prevent droop by the connector pressing part having a function of a support member. Also, visibility of the distal section is improved.

In accordance with the embodiments, the circuit body is a flat connecting member formed in a flat shape.

According to the structure, the electrical connecting member with the flat shape such as a flexible printed circuit board (FPC) or a flexible flat cable (FFC) is used as the circuit body. Therefore, space can be saved by the thinned amount.

In accordance with the embodiments, each of the distal sections of the circuit body includes a positional deviation accommodation part capable of displacing the each of the distal sections itself at least in the connector arrangement direction.

According to the structure, since the distal section of the circuit body is formed with the portion for absorbing the positional deviation, the collective connection structure can be easily made. Also, a workability of attaching the distal section of the circuit body to the circuit body holding part of the guide frame can be improved by using characteristics of the displaceable positional deviation accommodation part.

In accordance with the embodiments, a resin guide frame is configured to collectively connect a plurality of circuit body side connectors respectively formed on a plurality of distal sections of a circuit body to a plurality of device side connectors. The guide frame is formed in a shape extending in a connector arrangement direction. The guide frame includes circuit body holding parts configured to hold the circuit body, and connector pressing parts configured to abut on connector side abutting parts of the circuit body side connectors. Each of the circuit body holding parts includes a circuit body placement surface on which the circuit body is placed, and a projection projecting from the circuit body placement surface and arranged with a clearance to the circuit body in the connector arrangement direction. Each of the connector pressing parts includes: an elastic part having elasticity in a connector connection direction, and a pressing side abutting part arranged in a side nearer to the circuit body side connector than the elastic part. The pressing side abutting part is formed so that an abutment with the connector side abutting part is ensured in the connector arrangement direction.

According to the structure, the guide frame collectively connects the plural connectors, and the guide frame is formed with the circuit body holding part for holding the circuit body while absorbing a positional deviation in the connector arrangement direction, and the connector pressing part for elastically abutting on the circuit body side connector along the connector connection direction. Therefore, even when positional deviations in the connector arrangement direction and the connector connection direction occur, the positional deviations can be absorbed. Consequently, the guide frame of has an effect capable of easily making collective connection even when the manufacturing positional deviations occur.

In accordance with the embodiments, in a circuit body holding state guide frame, a circuit body is held in the guide frame in order to collectively connect a plurality of circuit body side connectors respectively formed on a plurality of distal sections of the circuit body to a plurality of device side connectors.

According to the structure, since the circuit body is held in the guide frame, the collective connection can be easily made even when the manufacturing positional deviations occur.

In accordance with the embodiments, a collective connecting method includes: aligning the plurality of circuit body side connectors with the plurality of device side connectors on the circuit body holding state guide frame; moving the circuit body holding state guide frame in the connector connection direction and collectively connecting the plurality of circuit body side connectors to the plurality of device side connectors; and detaching the guide frame from the circuit body holding state guide frame after connection According to the method, a better method for collectively connecting the plural circuit body side connectors to the plural device can be provided.

DESCRIPTION OF REFERENCE NUMERALS AND SIGNS

1 . . . SOLENOID VALVE (DEVICE)
2 . . . SOLENOID FIXING MEMBER
3 . . . OUTER PERIPHERAL SURFACE
4 . . . DEVICE SIDE CONNECTOR
5 . . . FRONT END FACE
6 . . . BACK END FACE
7 . . . ELECTRIC WIRE
8 . . . POSITIONING PART
9 . . . BASE
10 . . . BULGED PART
11 . . . SLIT PART
12 . . . CONNECTOR HOUSING
13 . . . TERMINAL
14 . . . FITTING RECESS
15 . . . LOCKING PROJECTION
16 . . . FPC WITH CIRCUIT BODY SIDE CONNECTORS
17 . . . GUIDE FRAME
18 . . . FPC HOLDING STATE GUIDE FRAME (CIRCUIT BODY HOLDING STATE GUIDE FRAME)
19 . . . FPC (CIRCUIT BODY, FLAT CONNECTING MEMBER)
20 . . . CIRCUIT BODY SIDE CONNECTOR
21 . . . TRUNK LINE PART
22 . . . BRANCH LINE PART (DISTAL SECTION OF CIRCUIT BODY)
23 . . . CONNECTOR HOUSING
24 . . . FITTING PROTRUSION
25 . . . FLEXIBLE LOCKING PIECE
26 . . . FPC FIXING PART
27 . . . CONNECTOR SIDE ABUTTING PART
28 . . . FRAME BODY
29 . . . FPC HOLDING PART (CIRCUIT BODY HOLDING PART)
30 . . . CONNECTOR PRESSING PART
31 . . . BOTH OF LEFT AND RIGHT ENDS
32 . . . FRONT EDGE (EDGE)
33 . . . BACK EDGE (EDGE)
34 . . . CIRCUIT BODY PLACEMENT SURFACE
35 . . . PROJECTION
36 . . . PLACEMENT SURFACE OPPOSED PART
37 . . . FPC INSERTION PART (CIRCUIT BODY INSERTION PART)
38 . . . CONTINUOUS PART
39 . . . ELASTIC PART
40 . . . PRESSING SIDE ABUTTING PART
41 . . . TRUNK LINE PLACEMENT PART
42,43 . . . TAPER
44 . . . POSITIONAL DEVIATION ACCOMMODATION PART
45 . . . TAPER
S . . . SPACE
C . . . CLEARANCE

What is claimed is:

1. A collective connecting structure of connectors configured to collectively connect a plurality of circuit body side connectors to a plurality of device side connectors, wherein the plurality of circuit body side connectors are respectively formed on a plurality of distal sections of a circuit body and arranged according to arrangement of the plurality of device side connectors, the structure comprising:

a guide frame extending in a connector arrangement direction, wherein the guide frame includes:

circuit body holding parts configured to hold the circuit body; and connector pressing parts configured to abut on connector side abutting parts of the circuit body side connectors, wherein each of the circuit body holding parts includes:

a circuit body placement surface on which the circuit body is placed; and a projection projecting from the circuit body placement surface and arranged with a clearance to the circuit body in the connector arrangement direction, and wherein each of the connector pressing parts includes:

an elastic part having elasticity in a connector connection direction; and a pressing side abutting part arranged in a side nearer to the circuit body side connector than the elastic part, wherein the pressing side abutting part is formed so that an abutment with the connector side abutting part is ensured in the connector arrangement direction.

2. The collective connecting structure of the connectors according to claim 1, wherein the projection includes:

a placement surface opposed part opposed to the circuit body placement surface at a predetermined distance; and a circuit body insertion part opened so that the circuit body is inserted.

3. The collective connecting structure of the connectors according to claim 1, wherein at least two circuit body holding parts are provided with respect to each of the distal sections of the circuit body, and wherein the two circuit body holding parts are arranged in a staggered state.

4. The collective connecting structure of the connectors according to claim 3, wherein a circuit body holding part nearest to the circuit body side connector in the two circuit body holding parts is arranged according to a position of an edge of the guide frame, and wherein the connector pressing part is projected along the connector connection direction from the circuit body holding part nearest to the circuit body side connector.

5. The collective connecting structure of the connectors according to claim 1, wherein a taper for guiding the connector is formed in a connector fitting start portion of the each of the circuit body side connectors.

6. The collective connecting structure of the connectors according to claim 1, wherein the connector pressing parts are projected from a surface opposite to the circuit body placement surface or an edge of the guide frame along the connector connection direction.

7. The collective connecting structure of the connectors according to claim 1, wherein the circuit body is a flat connecting member formed in a flat shape.

8. The collective connecting structure of the connectors according to claim 7, wherein each of the distal sections of the circuit body includes a positional deviation accommodation part capable of displacing the each of the distal sections itself at least in the connector arrangement direction.

9. A guide frame made of resin configured to collectively connect a plurality of circuit body side connectors respectively formed on a plurality of distal sections of a circuit body to a plurality of device side connectors, wherein the guide frame is formed in a shape extending in a connector arrangement direction, wherein the guide frame comprises:

circuit body holding parts configured to hold the circuit body; and connector pressing parts configured to abut on connector side abutting parts of the circuit body side connectors, wherein each of the circuit body holding parts includes:

a circuit body placement surface on which the circuit body is placed; and a projection projecting from the circuit body placement surface and arranged with a clearance to the circuit body in the connector arrangement direction, and wherein each of the connector pressing parts includes:

an elastic part having elasticity in a connector connection direction; and a pressing side abutting part arranged in a side nearer to the circuit body side connector than the elastic part, wherein the pressing side abutting part is formed so that an abutment with the connector side abutting part is ensured in the connector arrangement direction.

10. A circuit body holding state guide frame in which a circuit body is held in the guide frame according to claim 9 in order to collectively connect the plurality of circuit body side connectors respectively formed on the plurality of distal sections of the circuit body to the plurality of device side connectors.

11. A collective connecting method of connectors, the method comprising:

aligning the plurality of circuit body side connectors with the plurality of device side connectors on the circuit body holding state guide frame according to claim 10;

moving the circuit body holding state guide frame in the connector connection direction and collectively connecting the plurality of circuit body side connectors to the plurality of device side connectors; and detaching the guide frame from the circuit body holding state guide frame after connection.

* * * * *